US006705538B2

(12) United States Patent
Fecht et al.

(10) Patent No.: US 6,705,538 B2
(45) Date of Patent: Mar. 16, 2004

(54) TWO-MEDIUM SPRAYING NOZZLE AND METHOD OF USING SAME

(75) Inventors: Albert Fecht, Riederich (DE); Ralf Hengstler, Reutlingen (DE)

(73) Assignee: Lechler GmbH & Co. KG, Metzingen (DE)

( * ) Notice: Subject to any disclaimer, the term of this patent is extended or adjusted under 35 U.S.C. 154(b) by 0 days.

(21) Appl. No.: 10/101,861

(22) Filed: Mar. 21, 2002

(65) Prior Publication Data

US 2002/0134862 A1 Sep. 26, 2002

(30) Foreign Application Priority Data

Mar. 22, 2001 (EP) ..... 01106427

(51) Int. Cl.[7] ..... A62C 5/02

(52) U.S. Cl. ..... 239/8; 239/399; 239/426; 239/432; 239/433; 239/434; 239/494; 239/497; 239/590; 239/590.3; 239/597; 239/600

(58) Field of Search ..... 239/1, 8, 11, 399, 239/419, 426, 432, 433, 434, 463, 487, 490, 491, 494, 496, 497, 589, 590, 590.5, 597, 598, 600, 590.3; 164/485, 486

(56) References Cited

U.S. PATENT DOCUMENTS

| | | | | | |
|---|---|---|---|---|---|
| 1,757,023 | A | * | 5/1930 | Smith | 239/399 |
| 3,567,116 | A | | 3/1971 | Lindlof | |
| 4,142,682 | A | * | 3/1979 | Bowen | 239/590 |
| 4,346,724 | A | * | 8/1982 | Mezger et al. | 239/598 |
| 4,511,087 | A | * | 4/1985 | Matsumoto | 239/433 |
| 4,591,099 | A | * | 5/1986 | Emory et al. | 239/149 |
| 4,989,788 | A | * | 2/1991 | Bendig et al. | 239/433 |
| 6,036,116 | A | * | 3/2000 | Bui | 239/432 |

FOREIGN PATENT DOCUMENTS

| | | |
|---|---|---|
| DE | 195 05 647 | 8/1996 |
| DE | 196 04 902 | 8/1997 |
| DE | 197 58 557 | 7/1999 |

* cited by examiner

*Primary Examiner*—Steven J. Ganey
(74) *Attorney, Agent, or Firm*—Crowell & Moring LLP

(57) ABSTRACT

A two-medium spraying nozzle is provided with a mixing chamber arranged in a housing and with one connection duct respectively leading into this mixing chamber for the feeding of a gaseous and of a liquid medium. A mouthpiece is connected behind the mixing chamber, in which mouthpiece a rotationally symmetrical central outlet opening is provided. In the bore of the mouthpiece, a swirl insert is arranged, and the outlet opening has a diameter which corresponds to no more than half the diameter of the bore of the mouthpiece. Such a two-medium spraying nozzle is unsusceptible to clogging and is particularly suitable for atomizing low-viscosity fluids for the cooling of continuous-casting systems for the production of steel.

34 Claims, 2 Drawing Sheets

TWO-MEDIUM SPRAYING NOZZLE AND METHOD OF USING SAME

BACKGROUND AND SUMMARY OF THE INVENTION

This application claims the priority of 01006427.6, filed in Europe on Mar. 22, 2002, the disclosure of which is expressly incorporated by reference herein.

The invention relates to a two-medium spraying nozzle, particularly for atomizing low-viscosity fluids for the cooling of continuous-casting systems, having a housing with a mixing chamber and having one connection duct respectively leading into this mixing chamber, for the feeding of a gaseous and a liquid medium, as well as having a mouthpiece connected downstream of the mixing chamber in the flow direction, the mouthpiece having an axial cylindrical bore and a rotationally symmetrical outlet opening.

In continuous-casting systems, a two-medium secondary cooling is provided for the production of steel billets or blooms. This two-medium secondary cooling is achieved predominantly by means of two-medium full-cone nozzles with an internal mixing of the media. Thus, for example, pneumatic atomizer nozzles of the 138.XXX series are known for this purpose, which are sold by the applicant (Lechler Katalog, "Die ganze Welt der Düsen technik" ("Complete World of Nozzle Technology", Edition 921, Print Note "Kat./10.92/D, E, F, GB/5000", Page 1.28). These full-cone pneumatic atomizer nozzles, which operate according to the hydrostatic pressure principle—the air pressure is kept constant—, are provided with a cylindrical mixing chamber. The air current leads axially into this cylindrical mixing chamber and tears apart into fine droplets a liquid (water) jet guided transversely to the air current into the mixing chamber. From the mixing chamber, the two-medium mixture is then guided through a ring duct to an also ring-shaped outlet opening which is formed by an opening of a larger diameter than a ring space and arranged at the lower end of the ring space coming out of the mixing chamber and by a rebounding plate centrally held in this opening. In this case, the rebounding plate is held by way of a central shaft in a mouthpiece provided with the outlet opening, and the ring-shaped outlet duct is formed on the inside by the shaft of the rebounding plate and on the outside by the wall of the mouthpiece. The two-medium mixture, which is formed largely homogeneously already in front of the outlet duct in the mixing chamber, when axially flowing through the mouthpiece, will then impact on the rebounding plate and will be conically delivered to the outside in the shape of a full-cone spraying jet.

In the case of such pneumatic atomizer nozzles, the actual ring-shaped outlet opening between the outer edge of the rebounding plate and the outlet opening of the mouthpiece is constructed only as a very narrow ring of a width of in the order of 0.7 mm. Nozzles of this type therefore tend to clog at the outlet when the operating media, that is, the air and the water can no longer be kept clean, which naturally takes place in the production of steel. Nozzles of this construction also demand very low manufacturing tolerances and exhibit, also along the entire pressure range, that is, when the hydrostatic pressure is changed, a considerable change of the spraying angle, in which case also the full-cone character cannot be maintained over the entire control range.

It is therefore an object of the present invention to develop a two-medium spraying nozzle of the initially mentioned type such that the nozzles become unsusceptible to clogging and can be used in the entire control range while the air consumption is low and the spraying angle is stable. This has the purpose of covering the product spectrum for the manufacturing of high-quality steel types which is wider in the case of modern continuous-casting systems. The two-medium spraying nozzles should in each case be adaptable to the width of the products to be manufactured without causing an overcooling.

For achieving this object, the invention comprises arranging a swirl insert in the bore of the mouthpiece and providing the outlet opening centrally on the bottom of the mouthpiece with a diameter which corresponds to no more than half the diameter of the bore of the mouthpiece.

This further development permits the arrangement of a relatively large outlet opening which is unsusceptible to clogging. Astonishingly, it was found in this case that the swirl insert arranged in the mouthpiece, does not, as was to be feared, act in the manner of a drop collector and cancel out again the desired intimate and homogeneous mixing of liquid and air. However, the swirl insert provides that the gas-liquid mixture is caused to rotate before reaching the outlet opening so that it can then under pressure exit conically from the mouthpiece. It was found that, by means of this construction, the spraying angle becomes significantly less dependent on the variable hydrostatic pressure. The nozzle is also unsusceptible to dirtying.

In a further development of the invention, the outlet opening may expand to an outlet cone whose outlet angle is adapted to the desired spraying angle. The portion of the bottom of the mouthpiece surrounding the outlet opening may in this case be aligned in a flat and rectangular manner to the axis of the bore. However, it is also contemplated that the portion of the bottom surrounding the outlet opening is rounded.

As a further development of the invention, the swirl insert may be drilled or milled and may be provided with several bores or with several milled slots arranged at the circumference which are uniformly distributed along the circumference. It was found that very good results can be achieved by means of such a swirl insert and that, as mentioned above, the feared separation of the two-medium mixture has not occurred. As a further development of the invention, the swirl insert was also provided with an axially extending center bore which has an inlet and outlet chamfer. This center passage opening, which is mounted in a centric manner, has a positive influence on the symmetry of distribution.

As a further development of preferred embodiments of the invention, it is expediently taken into account that the sum of the free cross-sections of all bores provided in the swirl insert or the sum of the free passage cross-sections of the center bore and of the passage slots milled in on the outside are larger than the passage cross-section of the outlet opening of the mouthpiece. This further development leads to the rotation of the two-medium mixture upstream the outlet opening and ensures the formation of the desired full-cone jet.

As a further development of preferred embodiments of the invention, the distance between the bottom of the mouthpiece and the swirl insert is in each case selected such that a homogeneous flow is achieved upstream of the outlet opening which no longer has the influences of the individual jets passing through the bores.

As a further development of preferred embodiments of the invention, the mixing chamber may have a cylindrical construction with connection ducts situated perpendicular with respect to one another, the mouthpiece being constructed as a screwed sleeve which is connected directly downstream of the mixing chamber. However, it is also contemplated to construct the mixing chamber such that the connection duct for the liquid leads into the mixing chamber by way of a nozzle, which mixing chamber is provided on the wall opposite this nozzle with an indentation as a rebound surface for the liquid jet coming from the nozzle, the air connection extending in the axial direction of the mixing chamber and perpendicular to the axis of the liquid jet. In this embodiment, an extension pipe can be provided between the mouthpiece and the mixing chamber, as in the case of other constructions (German Patent Document DE 195 05 647). In this case, the mouthpiece can be fastened by way of a union nut on the extension pipe.

The invention will be illustrated by means of two embodiments in the drawing and will be explained in the following.

Other objects, advantages and novel features of the present invention will become apparent from the following detailed description of the invention when considered in conjunction with the accompanying drawings.

DETAILED DESCRIPTION OF THE DRAWINGS

Figure 1:
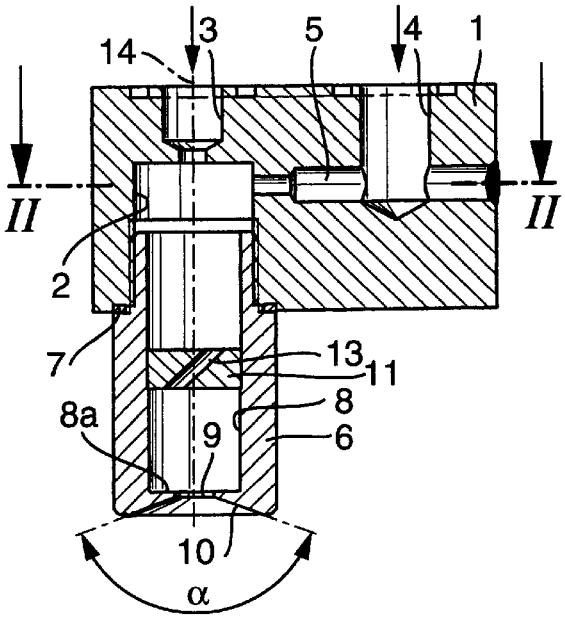
FIG. 1 is a schematic longitudinal sectional view of a two-medium spraying nozzle constructed according to a preferred embodiment of the invention.

FIG. 1 illustrates a two-medium spraying nozzle, in which air and water are mixed with one another for generating a spraying jet. The two-medium spraying nozzle according to FIGS. 1 and 2 has a housing 1 in which, on the one hand, a cylindrical mixing chamber 2 is provided with a coaxially arranged air feeding duct 3 and, on the other hand, a water feeding duct 4 is provided with a transverse bore 5 to the mixing chamber 2. The liquid—in the present case, water—therefore enters the mixing chamber 2 in the form of a jet perpendicular to the flow direction of the air introduced through the feeding duct 3. The water jet is thereby torn open and the air and the water are intimately mixed.

A mouthpiece 6, which is constructed as a screwed sleeve and is sealed off with respect to the housing 1 by means of a sealing ring 7, is screwed into the mixing chamber 2 which is provided with an internal thread at the lower end. The mouthpiece 6 is provided with a cylindrical bore 8 arranged coaxially with respect to the mixing chamber 2. In the bottom 8*a* of the bore 8, a circular outlet opening 9 is centrically arranged whose diameter is, however, smaller than the diameter of the bore 8 and measures no more than half this diameter. In the flow direction, on the outside, the outlet opening 9 merges into an expanding outlet cone 10 which in the embodiment shown has an angle $\alpha$ of approximately 140°. This angle is designed for generating a spraying angle of 90°. It is known that the generated spraying jet shrinks because of the vacuum formation at the cone 10 behind the outlet.

Figure 5:
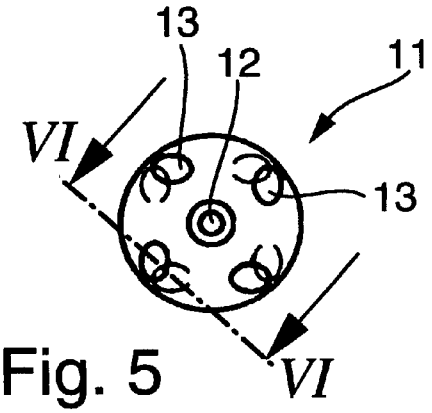
FIG. 5 is a top view of a drilled swirl insert as provided in the mouthpieces of FIGS. 1 and 3.
Figure 6:
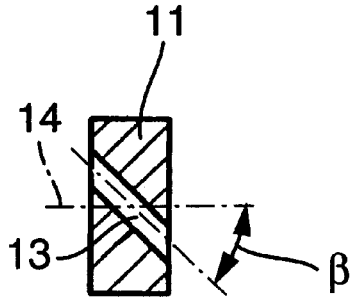
FIG. 6 is a partial sectional view of the swirl insert of FIG. 5 in the direction of the section line VI—VI.
Figure 7:
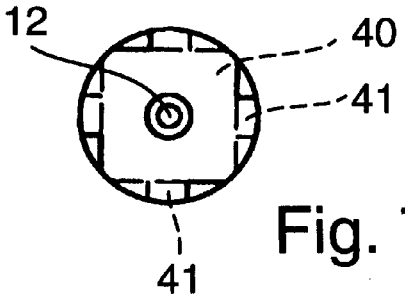
FIG. 7 is a top view of a swirl insert with swirl-generating grooves milled into the circumference.
Figure 8:
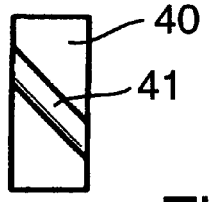
FIG. 8 is a lateral view of the swirl insert of FIG. 7.

In the cylindrical bore 8 of the mouthpiece 6, a swirl insert 11 is provided at a distance from the bottom 8*a*, which swirl insert 11 is fitted into the bore 8, for example, by means of a press fit. According to FIGS. 5 and 6, this swirl insert 11 can be produced by drilling, specifically such that a central center bore 12, which is chamfered at the inlet and at the outlet, is surrounded by several diagonal bores 13 uniformly distributed along the circumference. Diagonal bores 13 are arranged at a certain angle $\beta$ with respect to the center axis 14 of the swirl insert which coincides with the center axis of the bore 8 and of the mixing chamber 2 of the connection duct 3. In the embodiment shown, the angle $\beta$ amounts to 45° but can also be varied to a certain extent. Therefore, when the air-water mixture formed in the mixing chamber 2 enters the swirl insert 11 and passes through the latter, it is caused to rotate in the space of the bore 8 between the swirl insert 11 and the outlet opening 9, the center bore 12 positively influencing the symmetry of distribution of the mixed jets flowing out of the swirl insert 11. The rotating two-medium mixture will then exit under pressure through the opening 9 and form a full-cone spraying jet.

It should be mentioned that the sum of the free passage cross-sections of the bores 12 and 13 in the swirl insert 11 should always be larger than the free passage cross-section of the outlet opening 9.

Figure 2:
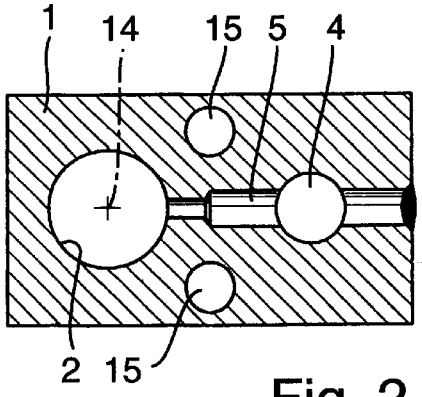
FIG. 2 is a sectional view of the housing and the mixing chamber of the two-medium spraying nozzle according to FIG. 1, viewed in the direction of the section line II—II.

FIG. 2 also shows two fastening bores 15 in the housing 1 which extend parallel to the axis 14 of the mixing chamber 2. By means of these fastening bores 15, the housing 1 can be mounted on a holding device.

Figure 3:
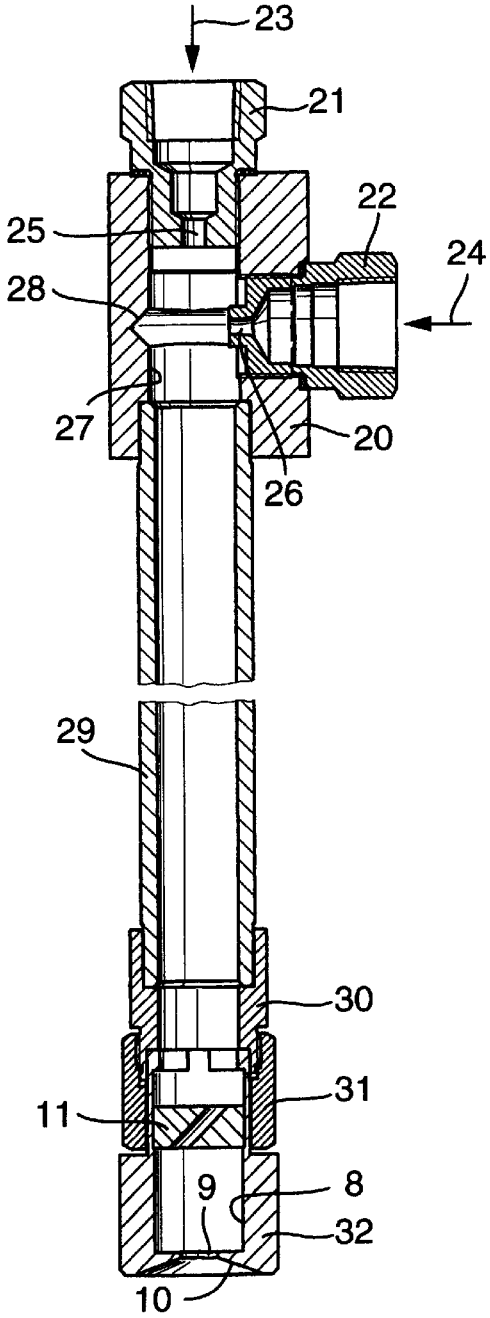
FIG. 3 is a schematic longitudinal sectional view of another embodiment of a two-medium spraying nozzle according to the invention, in which an extension pipe with the mouthpiece is joined to the housing with the mixing chamber.
Figure 4:
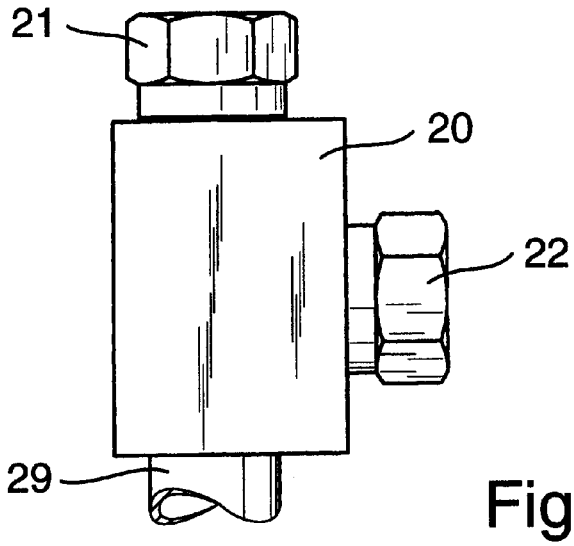
FIG. 4 is a lateral view of the housing of the two-medium spraying nozzle according to FIG. 3 with the air and water connection.

FIG. 3 shows a modified embodiment with a housing 20 which is provided with two screwed-in connections 21 and 22, whose diameter narrows in each case in the flow direction indicated by means of the arrows 23 and 24. Both inserts 21 and 22 lead by means of their nozzle-type outlet openings 25 and 26 into a mixing chamber 27 which extends coaxially with respect to the screwed connection 21 and has an approximately cylindrical construction. The wall of the mixing chamber 27 situated opposite the nozzle 26 is provided which an indentation 28 which is used as a rebound surface for the water jet entering in the direction of the arrow 24 and tears open the water jet by the impact, so that the air flowing in in the direction of the arrow 23 can cause the desired uniform mixing between the air and the water. Such housings 20 with a mixing chamber constructed as described above are described in German Patent Document DE 196 04 902 A1.

The mixing chamber 27 is adjoined by an extension pipe 29 which is equipped at the lower end with a fitted-on sleeve 30 with an external thread which, in turn, has the purpose of receiving a union nut 31 by means of which a mouthpiece 32 is held on the lower pipe end. The mouthpiece 32 has a construction analogous to that of the mouthpiece 6 of FIG. 1. The bore 8 of the mouthpiece 32, the swirl insert 11 and the outlet opening 9 were therefore provided with identical reference numbers. With respect to the full-cone spraying jet emerging from the mouthpiece 32, the method of operation of the two-medium spraying nozzle arrangement according to FIG. 3 also corresponds to that of the two-medium spraying nozzle of FIG. 1.

Instead of the drilled swirl insert of FIGS. 5 and 6, FIGS. 7 and 8 show a swirl insert 40 which can also be used and which was produced by milling. This swirl insert 40 also has a central center bore 12, but the swirl-generating passage ducts are formed by the grooves 41 diagonally milled into the outer circumference of the swirl insert 40. With respect to the free passage cross-sections, it is also true here that the free passage cross-sections of the grooves 41, which after the installation are closed off on the outside by the bore 8 of the mouthpiece 6 or 32, must also be larger than the free passage cross-section of the outlet opening 9.

A drilled swirl insert (FIG. 5) or a milled swirl insert (FIG. 7) respectively is illustrated as the swirl insert. Embodiments are also contemplated with provision of an X-type swirl insert which is known per se and has a very slight slope.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Two-medium nozzle for atomizing low-viscosity fluids for the cooling of continuous-casting systems, comprising:

a housing with a mixing chamber;

one connection duct leading into the mixing chamber, for the feeding of a gaseous medium flow to the mixing chamber in a gaseous medium flow direction;

one connection duct leading into the mixing chamber for the feeding of a liquid medium in the form of a liquid medium jet directed in a liquid medium jet direction which is at an angle with respect to the gaseous medium flow direction and which intersects with the gaseous medium flow and is thereby torn open in the gaseous medium flow such that the gas and liquid medium are intimately mixed in the mixing chamber; and a mouthpiece connected downstream of the mixing chamber in the gaseous medium flow direction, the mouthpiece having a cylindrical bore and a rotationally symmetrical outlet opening, wherein a swirl insert is arranged in the bore of the mouthpiece; and wherein the outlet opening is provided centrally on a bottom of the mouthpiece with a diameter which corresponds to no more than half the diameter of the bore of the mouthpiece.

2. Two-medium spraying nozzle according to claim 1, wherein the outlet opening expands to an outlet cone whose outlet angle ($\alpha$) is adapted to a desired spraying angle.

3. Two-medium spraying nozzle according to claim 2, wherein a portion of the bottom surrounding the outlet opening is aligned in a flat and rectangular manner with respect to the axis of the bore.

4. Two-medium spraying nozzle according to claim 2, wherein a portion of the bottom surrounding the outlet opening is rounded.

5. Two-medium spraying nozzle according to claim 1, wherein a portion of the bottom surrounding the outlet opening is aligned in a flat and rectangular manner with respect to the axis of the bore.

6. Two-medium spraying nozzle according to claim 1, wherein a portion of the bottom surrounding the outlet opening is rounded.

7. Two-medium spraying nozzle according to claim 1, wherein the swirl insert is drilled or milled.

8. Two-medium spraying nozzle according to claim 7, wherein the swirl insert is provided with several bores or several grooves arranged on the outer circumference which are uniformly distributed on the circumference.

9. Two-medium spraying nozzle according to claim 8, wherein the swirl insert has a center bore which extends in the axial direction and has an inlet and outlet chamfer.

10. Two-medium spraying nozzle according to claim 9, wherein a sum of the free passage cross-sections of the bores or grooves is larger than the passage cross-section of the outlet opening of the mouthpiece.

11. Two-medium spraying nozzle according to claim 8, wherein a sum of the free passage cross-sections of the bores or grooves is larger than the passage cross-section of the outlet opening of the mouthpiece.

12. Two-medium spraying nozzle according to claim 1, wherein the distance between the bottom and the swirl insert is selected such that a homogeneous flow is achieved in front of the outlet opening.

13. Two-medium spraying nozzle according to claim 1, wherein the mixing chamber has a cylindrical construction with connection ducts situated perpendicular to one another, and the mouthpiece is a screwed sleeve which is connected directly downstream of the mixing chamber.

14. Two-medium spraying nozzle according to claim 1, wherein the connection duct for the liquid leads into the mixing chamber in a nozzle-type manner, which mixing chamber is provided on a wall situated opposite the nozzle-type connection duct with an indentation as a rebound surface for the liquid jet coming from the nozzle, an air connection duct extending in an axial direction of the mixing chamber and being situated perpendicular to the axis of the liquid jet.

15. Two-medium spraying nozzle according to claim 14, wherein an extension pipe is provided between the mouthpiece and the mixing chamber, and the mouthpiece is fastened on this extension pipe by means of a union unit.

16. A nozzle assembly comprising:

a housing with a mixing chamber, a first connection duct operable to feed a gaseous medium flow to the mixing chamber in a gaseous medium flow direction, a second connection duct operable to feed a liquid medium to the mixing chamber in the form of a liquid medium jet directed in a liquid medium jet direction which is at an angle with respect to the gaseous medium flow direction and which intersects with the gaseous medium flow and is thereby torn open in the gaseous medium flow such that the gas and liquid medium are intimately mixed in the mixing chamber, a spray outlet mouthpiece disposed downstream of the mixing chamber in the gaseous medium flow direction, said mouthpiece having a cylindrical mouthpiece bore connected with a mouthpiece outlet openings said mouthpiece outlet opening exhibiting a flow-cross-section area which is no larger than half the flow cross-sect of the mouthpiece bore; and a swirl insert disposed in the mouthpiece bore spaced from the outlet opening.

17. A nozzle assembly according to claim 16, wherein said mouthpiece bore is axially aligned with said mouthpiece outlet opening.

18. A nozzle assembly according to claim 17, wherein said first connection duct is aligned with the mouthpiece bore and outlet opening.

19. A nozzle assembly according to claim 18, wherein said second connection duct is configured to supply the liquid to the mixing chamber at an angle with respect to the supply of gaseous medium the first connection duct.

20. A nozzle assembly according to claim 19, wherein said insert is disposed to form a downstream end of the mixing chamber.

21. A nozzle assembly according to claim 20, wherein said insert includes a central bore and a plurality of inclined insert openings disposed around said central bore.

22. A nozzle assembly according to claim 16, wherein said insert includes a central bore and a plurality of inclined insert openings disposed around said central bore.

23. A nozzle assembly according to claim 22, wherein said inclined insert openings are drilled holes through the insert.

24. A nozzle assembly according to claim 21, wherein said inclined insert openings are formed by milled slots along circumferential portions of the insert and by facing portions of said mouthpiece bore.

25. A nozzle assembly according to claim 16, wherein said mouthpiece is threadably attached to said housing.

26. A nozzle assembly according to claim 16, wherein said first connection duct is in a first connection duct piece threadably attached to said housing.

27. A nozzle assembly according to claim 16, wherein said second connection duct is in a second connection duct piece threadably attached to said housing.

28. A nozzle assembly according to claim 16 comprising:

an extension pipe connected between the housing and the mouthpiece.

29. A nozzle assembly according to claim 16, wherein said first and second connection ducts are formed integrally in said housing.

30. A nozzle assembly according to claim 16, wherein said nozzle assembly is configured to spray atomized cooling water for cooling continuous casting systems with air supplied under pressure to the first connection duct and water supplied under pressure to the second connection duct.

31. A method of cooling a continuous casting system using a nozzle assembly comprising:

a housing with a mixing chamber, a first connection duct operable to feed a gaseous medium flow to the mixing chamber in a gaseous medium flow direction, a second connection duct operable to feed a liquid medium to the mixing chamber in the form of a liquid medium jet directed in a liquid medium jet direction which is at an angle with respect to the gaseous medium flow direction and which intersects with the gaseous medium flow and is thereby torn open in the gaseous medium flow such that the gas and liquid medium are intimately mixed in the mixing chamber, a spray outlet mouthpiece disposed downstream of the mixing chamber in the gaseous medium flow direction, said mouthpiece having a cylindrical bore mouthpiece connected with a mouthpiece outlet opening said mouthpiece outlet opening exhibiting a flow-cross-section area which is no larger than half the flow cross-section of the mouthpiece bore; and a swirl insert disposed in the mouthpiece bore spaced from the outlet opening;

said method comprising:

supplying pressurized air to said first connection duct;

supplying pressurized water to said second connection duct; and directing said outlet opening toward said casting system to spray atomized water to cool said casting system.

32. A nozzle assembly comprising:

a housing with a mixing chamber, a first connection duct operable to feed a gaseous medium to the mixing chamber, a second connection duct operable to feed a liquid medium to the mixing chamber, a spray outlet mouthpiece disposed downstream of the mixing chamber, said mouthpiece having a mouthpiece bore connected with a mouthpiece outlet opening said mouthpiece outlet opening exhibiting a flow-cross-section area which is no larger than half the flow cross-section of the mouthpiece bore; and a swirl insert disposed in the mouthpiece bore spaced from the outlet opening, and wherein said insert includes a central bore and a plurality of inclined insert openings disposed around said central bore.

33. A nozzle assembly according to claim 32, wherein said inclined insert openings are drilled holes through the insert.

34. A nozzle assembly according to claim 32, wherein said inclined insert openings are formed by milled slots along circumferential portions of the insert and by facing portions of said mouthpiece bore.

* * * * *